US010533515B2

(12) United States Patent
Kusaka et al.

(10) Patent No.: US 10,533,515 B2
(45) Date of Patent: Jan. 14, 2020

(54) ASSEMBLING METHOD OF CORES

(71) Applicant: TOYOTA JIDOSHA KABUSHIKI KAISHA, Toyota-shi, Aichi-ken (JP)

(72) Inventors: Yusei Kusaka, Toyota (JP); Kazuya Mikashima, Nagoya (JP); Hiroyuki Ikuta, Nisshin (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 409 days.

(21) Appl. No.: 15/438,143

(22) Filed: Feb. 21, 2017

(65) Prior Publication Data

US 2017/0241370 A1 Aug. 24, 2017

(30) Foreign Application Priority Data

Feb. 24, 2016 (JP) ..... 2016-033430

(51) Int. Cl.
*F02F 1/14* (2006.01)

(52) U.S. Cl.
CPC ..... *F02F 1/14* (2013.01); *F02F 2200/06* (2013.01)

(58) Field of Classification Search
CPC . F02F 1/14; F02F 1/24; F02F 2200/06; B22C 9/108; B22C 9/103
See application file for complete search history.

(56) References Cited

U.S. PATENT DOCUMENTS

2006/0108084 A1* 5/2006 Bassi ..... B22C 7/02 164/34
2009/0091057 A1* 4/2009 Keys, Sr. ..... B22C 9/108 264/219
2009/0165298 A1* 7/2009 Nagafuchi ..... B22C 9/103 29/888.06

FOREIGN PATENT DOCUMENTS

| | | | |
|---|---|---|---|
| JP | 08-276243 | A | 10/1996 |
| JP | 2013-086117 | A | 5/2013 |
| JP | 2013-133746 | A | 7/2013 |
| JP | 2016-130505 | A | 7/2016 |
| WO | 2016/113786 | A1 | 7/2016 |

* cited by examiner

*Primary Examiner* — Ryan J. Walters
(74) *Attorney, Agent, or Firm* — Sughrue Mion, PLLC

(57) ABSTRACT

An intake-port core includes a body part having the same outer shape as that of the intake port, a port-injector part having the same outer shape as that of a port-injector insertion part, and an extending part. A cooling-water flow-passage core includes a water-jacket core having the same outer shape as that of a water jacket. The intake-port core is inserted from the extending part thereof into the water-jacket core so as to join the cooling-water flow-passage core to the intake-port core. Thereafter, a core print part that is a separate body from the intake-port core is joined to the intake-port core.

7 Claims, 9 Drawing Sheets

S3

S4

S5

S6

ASSEMBLING METHOD OF CORES

INCORPORATION BY REFERENCE

The disclosure of Japanese Patent Application No. 2016-033430 filed on Feb. 24, 2016 including the specification, drawings and abstract is incorporated herein by reference in its entirety.

BACKGROUND

1. Technical Field

The present disclosure relates to a method of assembling cores to a die, the cores used in casting of a cylinder head of an engine including a water jacket configured to cover a wall surface of a intake port.

2. Description of Related Art

In casting of a cylinder head of an engine, it is common to assemble multiple cores used for forming inner spaces of the cylinder head, such as an intake port, an exhaust port, a water jacket, and a coolant flow passage, at respective predetermined positions in a die used for molding an outer shape of the cylinder head. With respect to such cores, for example, Japanese Patent Application Publication No. 2013-086117 discloses an intake-port core used for casting a cylinder head of an engine including an injector to inject fuel toward the intake port.

The intake-port core includes a body part for forming an intake port, an injector part projectingly provided on a wall surface of the body part so as to form an injector insertion part, and a core print part provided to a longitudinal end of the body part so as to fix the body part to a die. This core print part is provided with multiple recesses having shapes corresponding to multiple projections formed in the die. These recesses are fitted to the corresponding projections, thereby assembling the intake-port core at a predetermined position in the die.

SUMMARY

The present inventors have conducted studies on casting of a cylinder head including a water jacket configured to cover a wall surface of an intake port with an injector insertion part for the purpose of enhancement of fuel efficiency and others. In order to cover the wall surface of the intake port, a water-jacket core may be provided with an inner wall having a shape corresponding to the shape of the wall surface. In order to form the intake port with the injector insertion part, there may be used an intake-port core including the body part, the injector part, and the core print part as aforementioned. In a state in which the water-jacket core is fixed to the die, the body part of the intake-port core are inserted inward of the inner wall, and thereafter, the core print part is fixed to this die, thereby combining these two cores. Accordingly, it is possible to cast the cylinder head with the above-configured water jacket.

Since the core print part has a greater size than a size of the body part, it is realistically impossible to insert the core print part into the water-jacket core. Hence, the body part can be inserted inward of the inner wall only from a side thereof where the core print part is not provided. Meanwhile, in light of cooling effect for the air flowing through the intake port, a greater cooling effect can be expected as the wall surface of the intake port are closer to the water jacket; therefore, there are needs to minimize a distance between the wall surface and the water jacket. In order to minimize the above distance for satisfying the aforementioned needs, if the distance between the body part and the inner wall is reduced in the assembly of the core to the die, the injector part projectingly provided on the wall surface of the body part become hindering. Hence, the body part cannot be inserted inward of the inner wall from the side thereof where the core print part is not provided. Consequently, in order to cast the cylinder head having the aforementioned smaller distance, it is necessary to develop a novel assembling method to be replaced with conventional assembling methods.

The present disclosure provides a novel method of assembling cores capable of casting a cylinder head having a smaller distance between a wall surface of an intake port with an injector insertion part and a water jacket.

A first aspect of the present disclosure is directed to a method of assembling cores to a die, the cores used for casting a cylinder head of an engine including: an intake port which includes an injector insertion part; and a water jacket covering a part of a wall surface of the intake port. The cores of the first aspect of the present disclosure includes: an intake-port core provided with a body part used for forming the intake port and an injector part that is projectingly provided on a wall surface of the body part and is used for forming the injector insertion part; a water-jacket core provided with an inner wall corresponding to the part of the wall surface of the intake port; and a core print part used for assembling the intake-port core to the die, the core print part being joinable to a longitudinal end of the body part and having a greater width than a width of the body part. The first aspect of the present disclosure includes: inserting the body part from a core-print-part joined end of the body part at which the body part is joined to the core print part into the water-jacket core; inserting a portion of the body part located closer to the core-print-part joined end than to the injector part inward of the inner wall; and joining the core print part to the core-print-part joined end after the body part is inserted into the water-jacket core.

If the cylinder head forms a part of a combustion chamber communicated with the intake port, and the cores further include a combustion-chamber core joinable to an end opposite to the core-print-part joined end of the body part and assemblable to the die, the first aspect of the present disclosure may further include: assembling the combustion-chamber core to the die before the body part is inserted into the water-jacket part, and joining the end opposite to the core-print-part joined end of the body part to the combustion-chamber core assembled to the die.

If the intake-port core further include a bent part provided to the end opposite to the core-print-part joined end of the body part, and the combustion-chamber core further includes a bent-part-accepted groove having a shape corresponding to a shape of the bent part, in the first aspect of the present disclosure, the bent part may be fitted into the bent-part-accepted groove so as to join the intake-port core to the combustion-chamber core.

If the intake-port core further includes an extending part at the core-print-part joined end, and the core print part further includes an accepting groove having a shape corresponding to a shape of the extending part, in the first aspect of the present disclosure, the extending part may be fitted into the accepting groove so as to join the intake-port core to the core print part.

If the core print part further includes a fitting part combinable with a positioning part of a lower die of the die, in the first aspect of the present disclosure, when the accepting groove and the extending part are fitted to each other, the core print part may be moved along a surface of the lower die so as to combine the positioning part and the fitting part.

If the die further include a core-print-portion fixing member configured to fix a position of the core print part in the die by combining the core-print-portion fixing member and the core print part, the first aspect of the present disclosure may further include pushing the core-print-portion fixing member from above the core print part so as to combine the core print part and the core-print-portion fixing member after the core print part is joined to the core-print-part joined end.

The water jacket of the first aspect of the present disclosure may cover a part of an upper surface and a part of a lower surface of the wall surface of the intake port.

According to the present disclosure, the intake-port core with the injector part is configured to be a separate body from the core print part, the intake-port core is inserted into the water-jacket core from the core-print-part joined end of the body part to be joined to the core print part, the portion of the body part located closer to the core-print-part joined end than to the injector part is inserted inward of the inner wall of the water-jacket core, and thereafter, the core print part can be joined to the core-print-part joined end. Accordingly, it is possible to cast the cylinder head having a smaller distance between the wall surface of the intake port with the injector insertion part and the water jacket.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Figure 1:
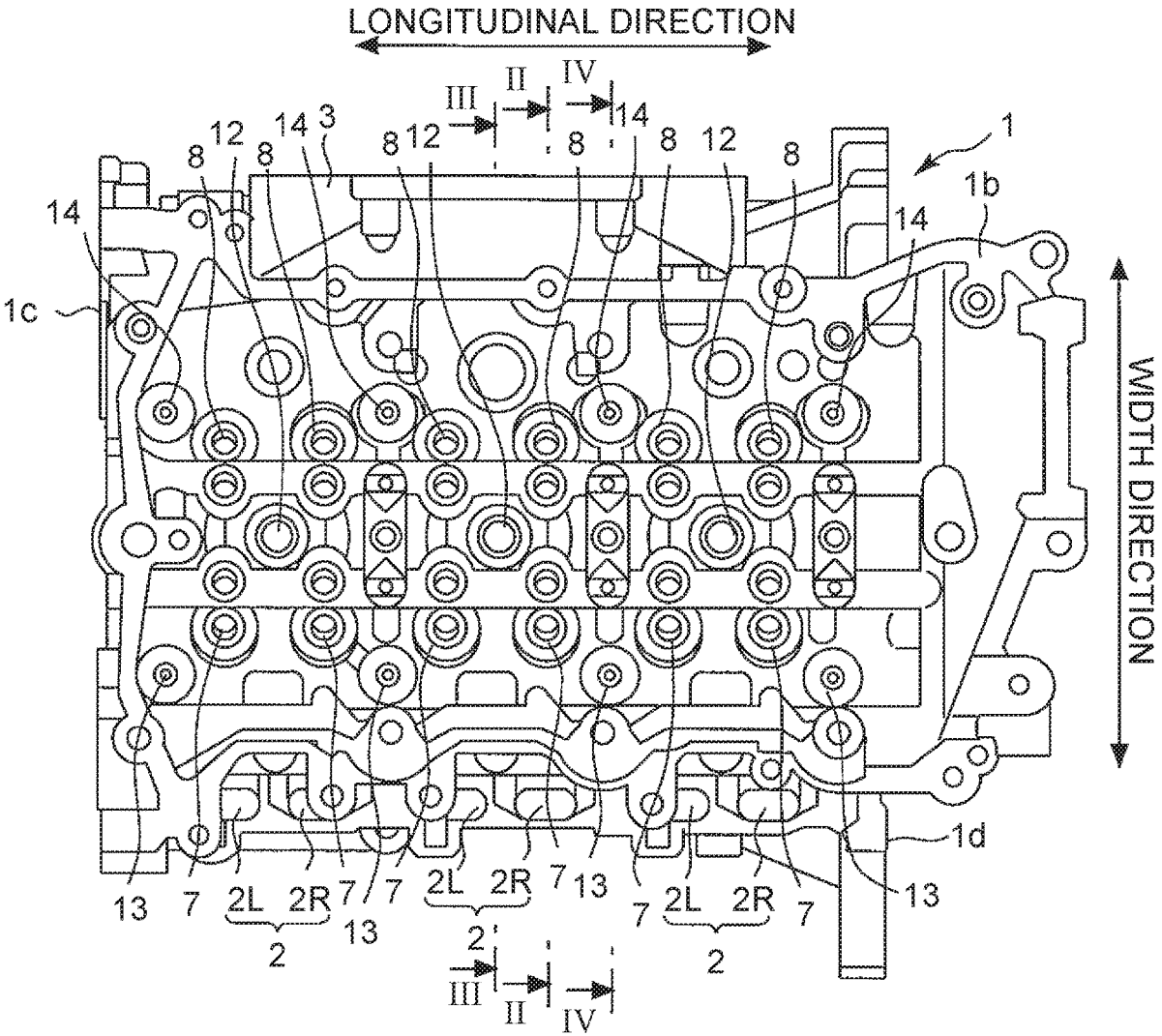
FIG. 1 is a drawing used for explaining a basic configuration of a cylinder head obtained by casting with an assembling method according to an embodiment.

Embodiments of the present disclosure will be described with reference to drawings, hereinafter. The common elements in the drawings will be denoted with identical reference numerals, and overlapping description thereof will be omitted. The present disclosure is not limited to the following embodiments.

It is assumed in the present embodiment that an engine is a water-cooled in-line three-cylinder engine of a spark-ignition type. A cooling water for cooling the engine is circulated between the engine and a radiator by a circulating system. The engine includes a cylinder block, and a cylinder head attached onto the cylinder block via a gasket. The cooling water is supplied to both the cylinder block and the cylinder head. The circulating system is an independent closed loop, and includes a radiator and a water pump. However, the circulating system may be configured as a multi-system type circulating system including multiple independent closed loops.

<Basic Configuration of Cylinder Head>

With reference to FIG. 1 to FIG. 4, a basic configuration of the cylinder head 1 produced by casting utilizing the assembling method according to the present embodiment will be described, hereinafter. In this description, plan views and sectional views of the cylinder head 1 are used. In the present specification, unless otherwise specifically mentioned, supposing that the cylinder head 1 is located more upward in a vertical direction than the cylinder block, positional relations among respective elements will be described. Of configurations of the cylinder head 1, a configuration of the cooling-water flow passage will be described in details.

<<Basic Configuration of Cylinder Head in Plan View>>

The basic configuration of the cylinder head 1 will be described with reference to a plan view as below. FIG. 1 is a plan view of the cylinder head 1 as viewed from a head-cover attachment surface 1*b* to which a head cover is attached. In the present specification, an axial direction of a crankshaft is defined as a longitudinal direction of the cylinder head 1, and a direction orthogonal to the longitudinal direction and also parallel with a cylinder-block fitting surface of the cylinder head 1 is define as a width direction of the cylinder head 1. Of end surfaces 1*c*, 1*d* in the longitudinal direction, the end surface 1*d* located on an output end side of the crankshaft is referred to as a rear end surface, and the other end surface 1*c* opposite to the end surface 1*d* is referred to as a front end surface.

The cylinder head 1 as shown in FIG. 1 is a cylinder head of an in-line three-cylinder engine of a spark-ignition type. Although not illustrated in FIG. 1, under a lower surface of the cylinder head 1, three combustion chambers of three cylinders are arranged with equal intervals in line in the longitudinal direction. In the cylinder head 1, three ignition-plug insertion holes 12 corresponding to the three combustion chambers are formed.

Three intake ports 2 of the three cylinders and an exhaust port 3 are opened in side surfaces of the cylinder head 1. Specifically, as viewed from the front end surface 1*c*, the intake ports 2 are opened in a right side surface of the cylinder head 1, and the exhaust port 3 is opened in a left side surface thereof. In the following description, if the cylinder head 1 is viewed from the front end surface 1*c*, a side surface located on the right is also referred to as a right side surface of the cylinder head 1, and a side surface located on the left is also referred to as a left side surface of the cylinder head 1.

Each of the intake ports 2 includes two branch ports 2L, 2R arranged in line in the longitudinal direction of the cylinder head 1. The branch ports 2L, 2R extend from each combustion chamber, and are independently opened in the right side surface of the cylinder head 1. In the exhaust port 3, multiple exhaust openings are collected into one inside the cylinder head 1, and this collected single exhaust port 3 is opened in the left side surface of the cylinder head 1. In the following description, if the cylinder head 1 is viewed from the front end surface 1*c*, the right side is also referred to as an intake side, and the left side is also referred to as an exhaust side.

In the cylinder head 1, each single cylinder is provided with two intake valves and two exhaust valves. In an upper surface of the cylinder head 1, two intake-valve insertion holes 7 and two exhaust-valve insertion holes 8 are so formed as to surround each single ignition-plug insertion hole 12. The intake-valve insertion holes 7 are connected to the intake ports 2 inside the cylinder head 1, and the exhaust-valve insertion holes 8 are connected to the exhaust port 3 inside the cylinder head 1.

In an inner side of the head-cover attachment surface 1*b*, there are formed head-bolt insertion holes 13, 14 through which head bolts used for assembling the cylinder head 1 to the cylinder block are inserted. Four head bolts are provided on each of the right and left sides relative to the combustion chamber line. On the intake side, the head-bolt insertion holes 13 are respectively formed at each position between each two adjacent intake ports 2, a position between the front end surface 1*c* and the nearest intake port 2 thereto, and a position between the rear end surface 1*d* and the nearest intake port 2 thereto. On the exhaust side, the head-bolt insertion holes 14 are respectively formed at each position between each two branching parts of the exhaust port 3 that branch relative to the corresponding combustion chambers, a position between the front end surface 1*c* and the exhaust port 3, and a position between the rear end surface 1*d* and the exhaust port 3.

An inner configuration of the cylinder head 1 as shown in FIG. 1 will be described with reference to a sectional view thereof. Sections of the cylinder head 1 of interest herein are a section that includes a central axis of the intake-valve insertion hole 7 of the cylinder head 1, and is vertical to the longitudinal direction thereof (section along line II-II in FIG. 1), a section that includes a central axis of the combustion chamber of the cylinder head 1, and is vertical to the longitudinal direction thereof (section along line III-III in FIG. 1), and a section that passes through between two adjacent combustion chambers of the cylinder head 1, and is vertical to the longitudinal direction thereof (section along line IV-IV in FIG. 1).

<<Basic Configuration of Cylinder Head as Viewed in Section that Includes Central Axis of Intake-Valve Insertion Holes, and is Vertical to Longitudinal Direction>>

Figure 2:
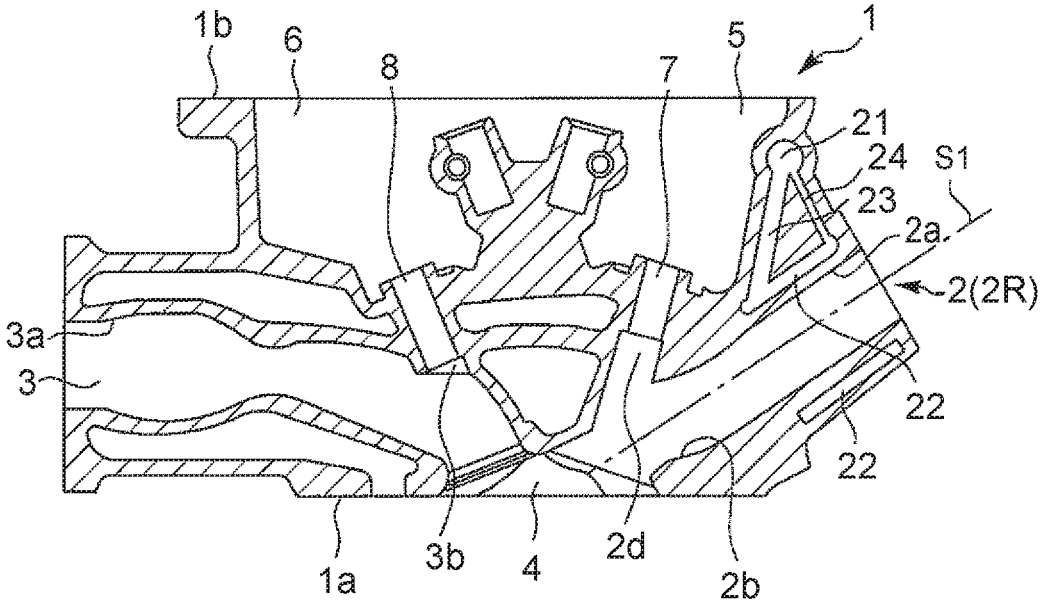
FIG. 2 is a sectional view showing a section taken along line II-II of FIG. 1.

FIG. 2 is a sectional view showing a section that includes central axes of the intake-valve insertion holes 7 of the cylinder head 1 in FIG. 1, and is vertical to the longitudinal direction thereof (section along line II-II in FIG. 1). As shown in FIG. 2, each combustion chamber 4 having a gable roof shape is formed in a cylinder-block fitting surface 1*a* that is the lower surface of the cylinder head 1. When the cylinder head 1 is assembled to the cylinder block, the combustion chamber 4 closes the cylinder from above so as to configure a closed space therein. If the closed space located between the cylinder head 1 and a piston is defined as a combustion chamber, this combustion chamber 4 may also be referred to as a combustion-chamber ceiling surface.

As viewed from the front end side of the cylinder head 1 (i.e., the front end surface 1*c* side in FIG. 1), the intake port 2 is opened in a right slope surface of each combustion chamber 4. A connected part between the intake port 2 and the combustion chamber 4, that is, an open end of the intake port 2 located on the combustion chamber side serves as an intake opening to be opened and closed by a not-illustrated intake valve. Since each cylinder is provided with two intake valves, two intake openings of the intake port 2 are formed in each combustion chamber 4. Inlets of the intake ports 2 are opened in the right side surface of the cylinder head 1. As aforementioned, each intake port 2 includes the two branch ports 2L, 2R arranged in line in the longitudinal direction, and these branch ports are connected to the intake openings formed in each combustion chamber 4. In FIG. 2, there is illustrated a branch port 2R located on the rear end side of the cylinder head 1 (i.e., on a rear end surface 1*d* side in FIG. 1). Each intake port 2 is a tumble-flow generating port that can generate a tumble flow in each corresponding combustion chamber 4.

The intake-valve insertion holes 7 into each of which a system of the intake valve is inserted are formed in the cylinder head 1. Each intake-valve insertion hole 7 is formed in a projecting shape on an upper surface 2*a* of each corresponding intake port 2, and is connected to a corresponding intake-valve insertion part 2*d* into which the system of the intake valve is inserted, as with the intake-valve insertion hole 7. On an upper surface of the cylinder head 1, and inward of the head-cover attachment surface 1*b*, there is provided each intake valve-gear chamber 5 in which a valve gear to operate the intake valve is housed. Each intake-valve insertion hole 7 straightly extends obliquely rightward and upward from the upper surface of the intake port 2 in the vicinity of each corresponding combustion chamber 4 to the intake valve-gear chamber 5.

As viewed from the front end of the cylinder head 1, the exhaust port 3 is opened in a left slope surface of each combustion chamber 4. A connected part between each exhaust port 3 and each corresponding combustion chamber 4, that is, an open end of the exhaust port 3 located on the combustion chamber side serves as an exhaust opening to be opened and closed by a not-illustrated exhaust valve. Since each cylinder is provided with two exhaust valves, two exhaust openings of the exhaust port 3 are formed in each combustion chamber 4. The exhaust port 3 has a manifold shape including six inlets (exhaust openings) provided to the exhaust valves of the respective combustion chambers 4, and one outlet that is opened in the left side surface of the cylinder head 1.

Exhaust-valve insertion holes 8 into each of which a system of the exhaust valve is inserted are formed in the cylinder head 1. Each exhaust-valve insertion hole 8 is connected to an exhaust-valve insertion part 3*b* projectingly provided on an upper surface 3*a* of the exhaust port 3, and into which the system of the exhaust valve is inserted, as with the exhaust-valve insertion hole 8. On the upper surface of the cylinder head 1 and inward of the head-cover attachment surface 1*b*, there is provided an exhaust valve-gear chamber 6 in which a valve gear to operate the exhaust valve is housed. Each exhaust-valve insertion hole 8 straightly extends obliquely leftward and upward from the upper surface of the exhaust port 3 in the vicinity of each corresponding combustion chamber 4 to the exhaust valve-gear chamber 6.

<<Basic Configuration of Cylinder Head as Viewed in Section that Includes Central Axis of Combustion Chamber and is Vertical to Longitudinal Direction>>

Figure 3:
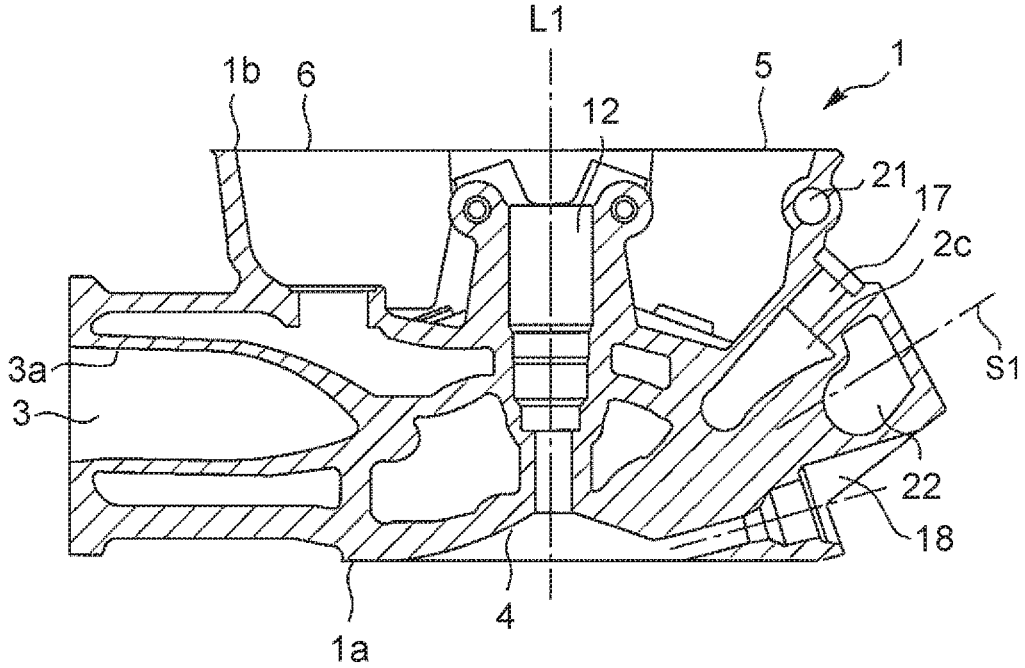
FIG. 3 is a sectional view showing a section taken along line III-III of FIG. 1.

FIG. 3 is a sectional view showing a section of the cylinder head 1 that includes a central axis L1 of each combustion chamber 4 of the cylinder head 1, and is vertical to the longitudinal direction thereof (section along line III-III in FIG. 1). The ignition-plug insertion holes 12 into which respective ignition plugs are fixed are formed in the cylinder head 1. Each ignition-plug insertion hole 12 is opened to a top portion of each corresponding combustion chamber 4 having a gable roof shape. The central axis L1 of each combustion chamber 4 coincides with the central axis of the cylinder head 1 if the cylinder head 1 is assembled to the cylinder block.

The intake ports 2 are disposed at respective positions located on the both sides relative to a plane that includes the central axis L1 of the combustion chamber 4 and is vertical to the longitudinal direction; therefore, no intake port 2 is included in the section as shown in FIG. 3. In the section as shown in FIG. 3, only a part of the exhaust port 3 is illustrated. The collected part of the exhaust port 3 is opened in the left side surface of the cylinder head 1.

A port-injector insertion hole 17 into which a port injector is inserted is formed in a side surface of the cylinder head 1 located more upward than each corresponding intake port 2. Each port-injector insertion hole 17 is connected to a port-injector insertion part 2*c* that intersects the intake port 2 at an acute angle, and is so formed as to upwardly project on an upper surface of a branch part of the intake port 2. The port injector (not illustrated) inserted in each corresponding port-injector insertion hole 17 projects a nozzle front end thereof from the port-injector insertion part 2*c* so as to inject the fuel toward the inside of the intake port 2.

A cylinder injector insertion hole 18 into which a cylinder injector is fixed is formed in a side surface of the cylinder head 1 located more downward of each corresponding intake port 2. A central axis of each cylinder injector insertion hole 18 is located on a plane that includes the central axis L1 of each combustion chamber 4, and is vertical to the longitudinal direction. Each cylinder injector insertion hole 18 is opened to each corresponding combustion chamber 4. The fuel is directly injected into each cylinder from the cylinder injector (not illustrated) inserted in each cylinder injector insertion hole 18.

<<Basic Configuration of Cylinder Head as Viewed in Section Vertical to Longitudinal Direction Passing Through Between Two Adjacent Combustion Chambers>>

Figure 4:
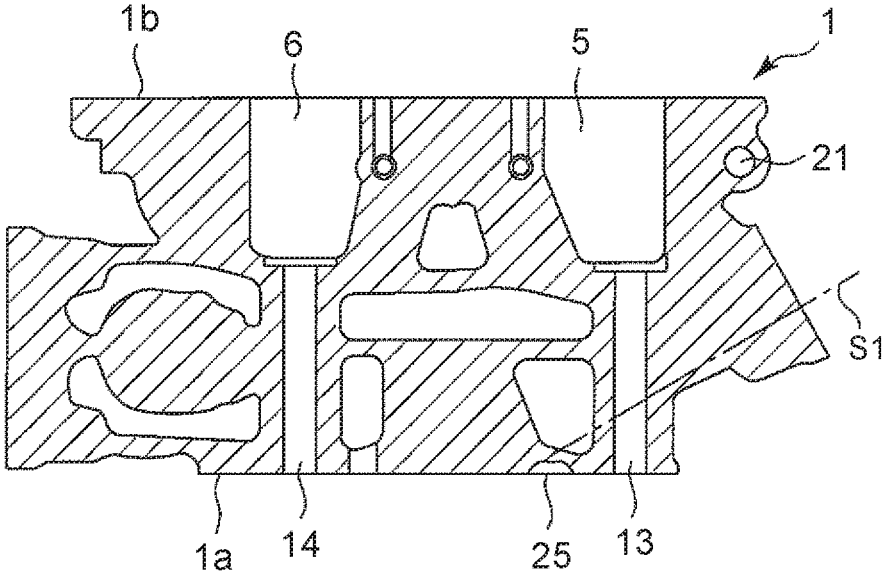
FIG. 4 is a sectional view showing a section taken along line IV-IV of FIG. 1.

FIG. 4 is a sectional view showing a section vertical to a longitudinal direction passing through between two adjacent combustion chambers of the cylinder head 1 (section along line IV-IV in FIG. 1). In the cylinder head 1, a head-bolt insertion hole 13 on the intake side is so formed as to extend downward from the intake valve-gear chamber 5 in the vertical direction. A head-bolt insertion hole 14 on the exhaust side is so formed as to extend downward from the exhaust valve-gear chamber 6 in the vertical direction. The head-bolt insertion holes 13, 14 are vertical to the cylinder-block fitting surface 1*a*, and are opened to the cylinder-block fitting surface 1*a*. A section as shown in FIG. 4 includes the central axes of the head-bolt insertion holes 13, 14, and is vertical to the longitudinal direction.

<Configuration of Cooling-Water Flow Passage>

With reference to FIG. 2 to FIG. 4, a configuration of a cooling-water flow passage of the cylinder head 1 obtained by the assembling method according to the present embodiment will be described, hereinafter.

<<Configuration of Cooling-Water Flow Passage of Cylinder Head as Viewed in Section that Includes Central Axis of Each Intake-Valve Insertion Hole of Cylinder Head, and is Vertical to Longitudinal Direction>>

In the section as shown in FIG. 2, in a region in the vicinity of the inlets of the intake ports 2, a water jacket 22 is so disposed as to extend along the upper surfaces 2*a* and lower surfaces 2*b* of the intake ports 2. A main flow passage 21 of the cooling-water flow passage 20 is disposed in a region located adjacent to the intake valve-gear chamber 5, and in the vicinity of the side surface of the cylinder head. A sub-flow passage 23 is so disposed as to extend from the main flow passage 21 along the intake valve-gear chamber 5 to be continued to the water jacket 22. Furthermore, an auxiliary flow passage 24 is configured as a flow passage having a smaller flow-passage section than that of the sub-flow passage 23, and is so disposed as to be continued from a top portion in the vertical direction of the water jacket 22 to the main flow passage 21.

<<Configuration of Cooling-Water Flow Passage of Cylinder Head as Viewed in Section that Includes Central Axis of Combustion Chamber, and is Vertical to Longitudinal Direction>>

In the section as shown in FIG. 3, the water jacket 22 is disposed in the vicinity of the inlets of the intake ports 2. The water jacket 22 becomes expanded in a downward direction from the central axis S1 while a predetermined wall thickness is left relative to the cylinder injector insertion hole 18. The main flow passage 21 of the cooling-water flow passage 20 is disposed in a region located adjacent to each intake valve-gear chamber 5 and in a vicinity of the side surface of the cylinder head.

<<Configuration of Cooling-Water Flow Passage of Cylinder Head as Viewed in Section that is Vertical to Longitudinal Direction Passing Through Between Two Adjacent Combustion Chambers>>

In a section as shown in FIG. 4, a part of a connecting flow passage 25 of the cooling-water flow passage that connects the water jacket to the cooling-water flow passage of the cylinder block is located in a region that faces the cylinder-block fitting surface 1*a* and is closer to the center of the cylinder head 1 than the head-bolt insertion holes 13 on the intake side. The main flow passage 21 of the cooling-water flow passage 20 is disposed in a region that is adjacent to the intake valve-gear chamber 5 and in the vicinity of the side surface of the cylinder head.

<Assembling Method of Cores>

With reference to FIG. 5A to FIG. 12, an assembling method of cores according to the present embodiment and an effect thereof will be described, hereinafter. In FIG. 5A to FIG. 7B, there are illustrated steps (Steps S1 to S6) of a casting process of the cylinder head 1 as described with reference to FIG. 1 to FIG. 4, and of these steps, Steps S2 to S5 correspond to the assembling method of the cores according to the present embodiment. In the description with reference to FIG. 5A to FIG. 7B, configurations of three types of cores that are assembly targets of the assembling method according to the present embodiment will be described by appropriately referring to FIG. 8A to FIG. 8C showing these cores that are extracted and enlarged. Hereinafter, in the present specification, positional relations among respective elements will be described by assuming that a lower die 30 of the die is disposed on a horizontal plane unless otherwise mentioned.

Figure 5A:
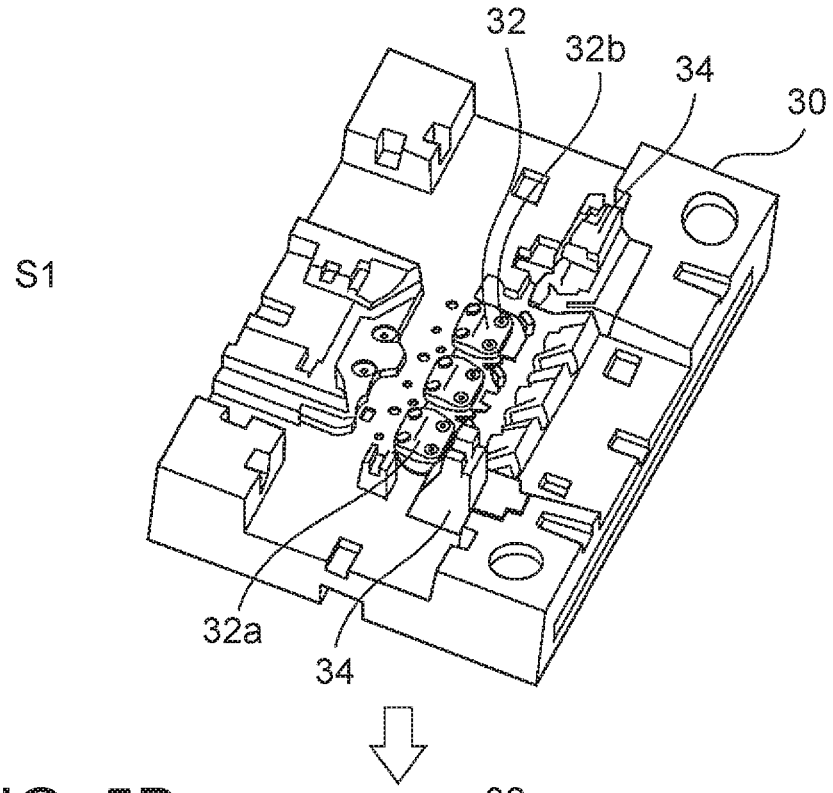
FIG. 5A is a drawing used for explaining a flow of the assembling method according to the embodiment.
Figure 8A:
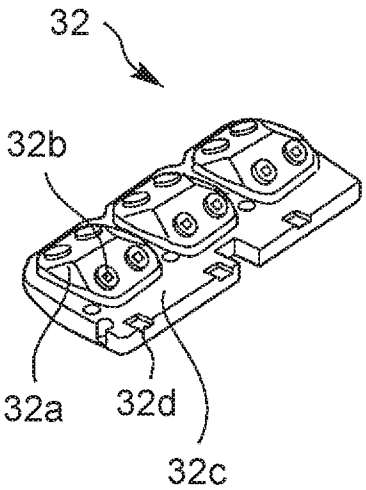
FIG. 8A is an enlarged view of a combustion-chamber core that is an assembly target of the assembling method according to the present embodiment.

In Step S1 as shown in FIG. 5A, a combustion-chamber core 32 and a water-passage support member 34 are assembled at respective predetermined positions in the lower die 30. The combustion-chamber core 32 is a core used for forming the combustion chambers 4 and others as described with reference to FIG. 2 to FIG. 3 in the cylinder head. As shown in FIG. 5A and FIG. 8A, the combustion-chamber core 32 includes combustion chamber parts 32*a* each having an outer shape corresponding to a inner shape of each combustion chamber 4 as described with reference to FIG. 2 to FIG. 3, and a bent-part-accepted groove 32*b* is formed on an upper surface of each combustion chamber part 32*a*. As shown in FIG. 8A, the combustion-chamber core 32 includes an outer-circumferential part 32*c* around an outer circumference of the combustion chamber parts 32*a*, and grooves 32*d* are formed on an upper surface of the outer-circumferential part 32*c*. The water-passage support member 34 is a member for supporting a cooling-water flow-passage core 38, and is assembled to the lower die 30 prior to the assembly of the combustion-chamber core 32.

Figure 5B:
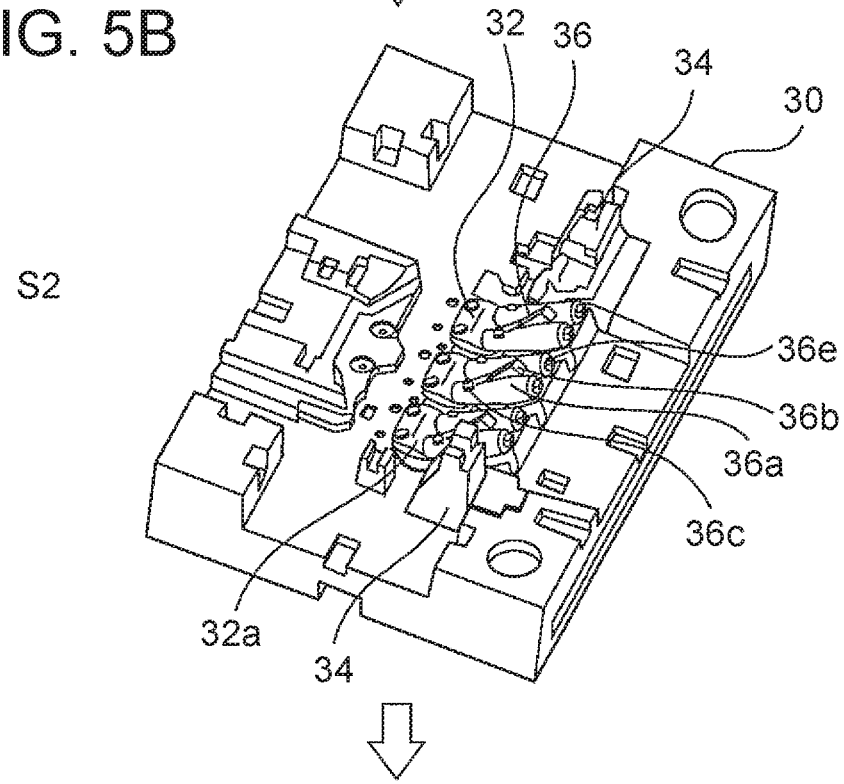
FIG. 5B is a drawing used for explaining the flow of the assembling method according to the embodiment.
Figure 8B:
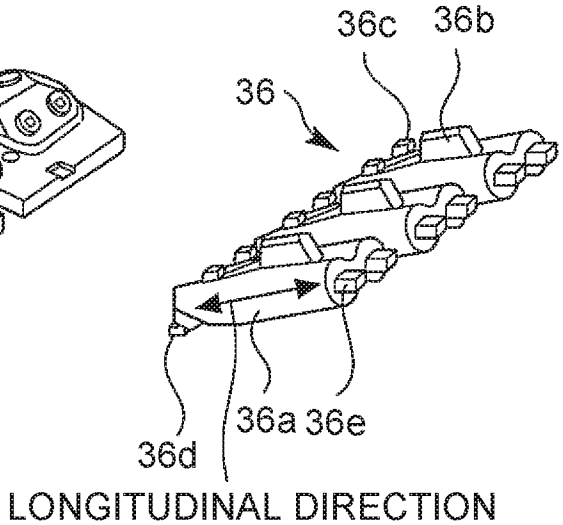
FIG. 8B is an enlarged view of intake-port cores that are an assembly target of the assembling method according to the present embodiment.

In Step S2 subsequent to Step S1, intake-port cores 36 are assembled to predetermined positions in the lower die 30. The intake-port cores 36 are cores used for forming the intake ports 2 and others as described with reference to FIG. 2 to FIG. 3 in the cylinder head. As shown in FIG. 5B and FIG. 8B, each intake-port core 36 includes a body part 36*a* having an outer shape corresponding to the inner shape of each intake port 2 as described with reference to FIG. 2 and FIG. 3, and a port-injector part 36*b* having an outer shape corresponding to the inner shape of each port-injector insertion part 2*c*, and an intake valve part 36*c* having an outer shape corresponding to the inner shape of each intake-valve insertion part 2*d*. As shown in FIG. 8B, bent parts 36*d* each having a shape corresponding to a shape of each bent-part-accepted groove 32*b* are formed at one longitudinal ends of the body parts 36*a*, and extending parts 36*e* are formed at the other ends thereof. In the assembly of the intake-port cores 36, the body parts 36*a* are joined to the combustion-chamber core 32. By fitting the bent parts 36*d* into the bent-part-accepted grooves 32*b*, the intake-port cores 36 are joined to the combustion-chamber core 32.

Figure 10:
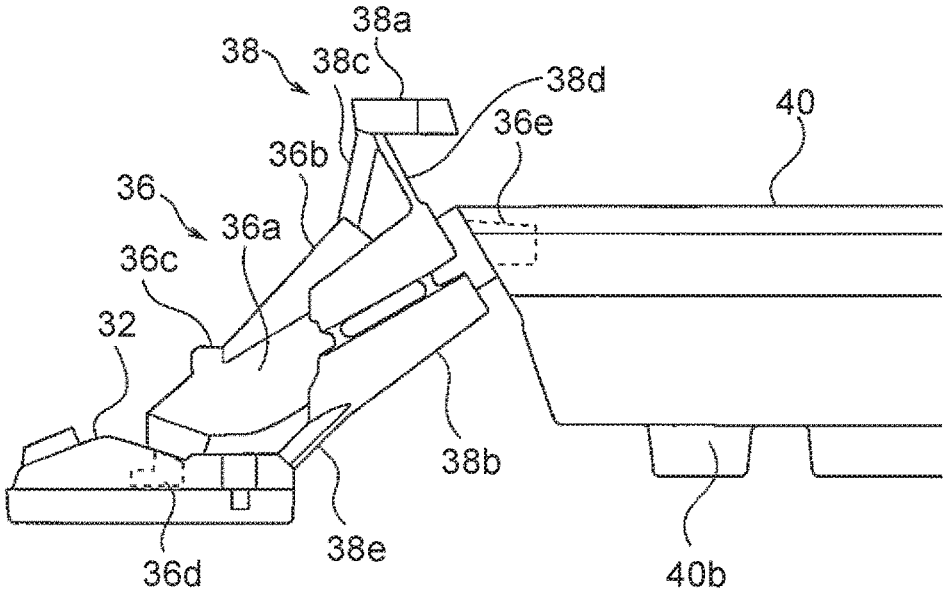
FIG. 10 is a drawing used for explaining the cores immediately after Step S4 in FIG. 6B.
Figure 12:
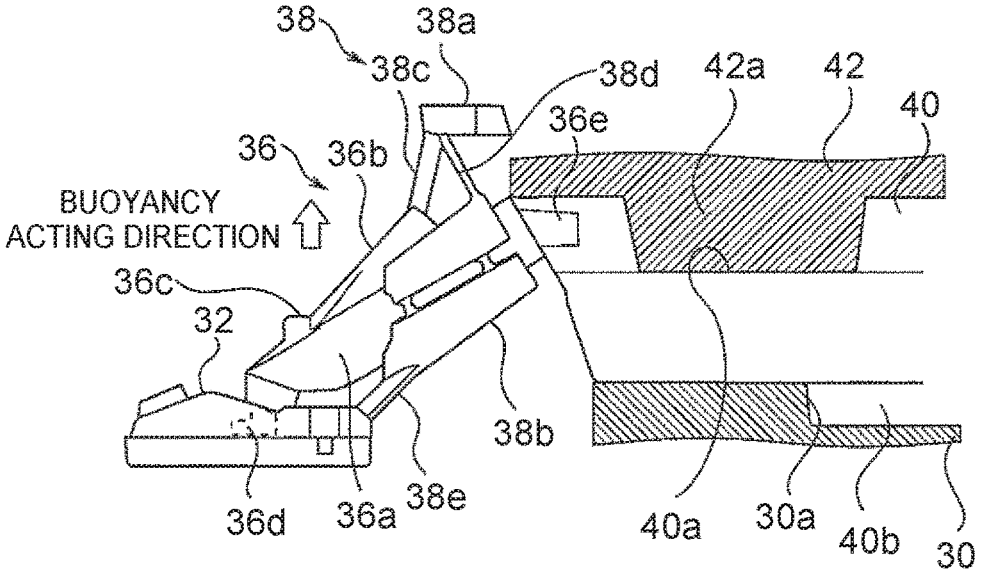
FIG. 12 is a drawing used for explaining the cores immediately after Step S5 in FIG. 7A.

A sectional shape of each bent part 36*d* is formed in an L-shape in which one end thereof extends in an extending direction of the combustion-chamber core 32, and the other end thereof extends vertically to the extending direction (see FIG. 10 or FIG. 12). The bent parts 36*d* each having the above sectional shape are fitted into the corresponding bent-part-accepted grooves 32*b* so as to join the intake-port cores 36 to the combustion-chamber core 32, thereby suppressing fall-down of the intake-port cores 36 extending in an obliquely upward direction. Since the assembling state of the intake-port cores 36 can be stable, it is also possible to stably carry out the combination between the intake-port cores 36 and the cooling-water flow-passage core 38 in Step S3 described later, and the joining of the intake-port cores 36 to a core print part 40 in Step S4. The sectional shape of each bent part 36*d* (or bent-part-accepted groove 32*b*) may be configured into a V-shape in which the one end of the bent part 36*d* extends in the extending direction of the combustion-chamber core 32, and the other end thereof obliquely extends relative to the extending direction, or may be configured into a U-shape in which the one end thereof extends in the extending direction of the combustion-chamber core 32, and an intermediate part thereof is curved to be continued to the other end thereof.

Figure 6A:
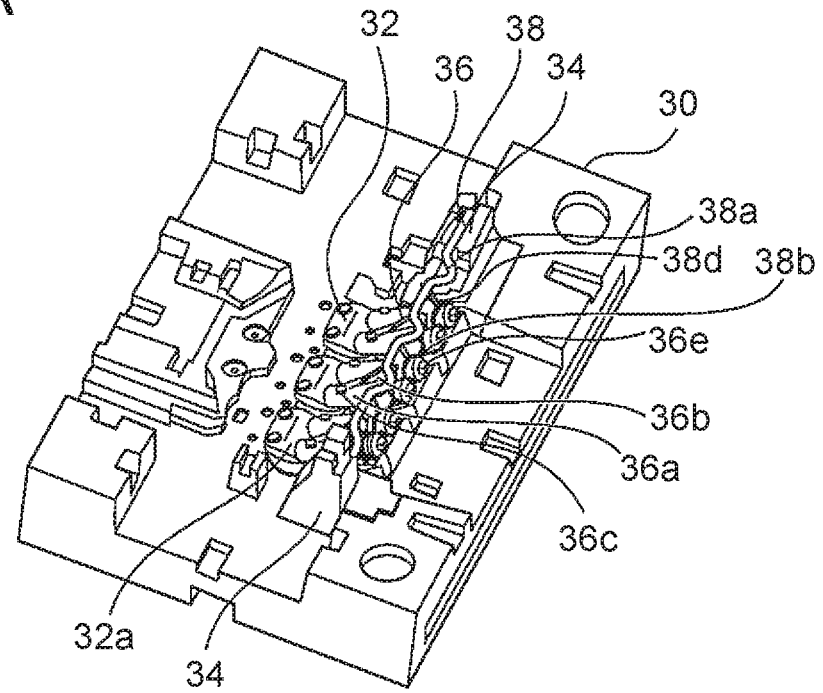
FIG. 6A is a drawing used for explaining the flow of the assembling method according to the embodiment.
Figure 8C:
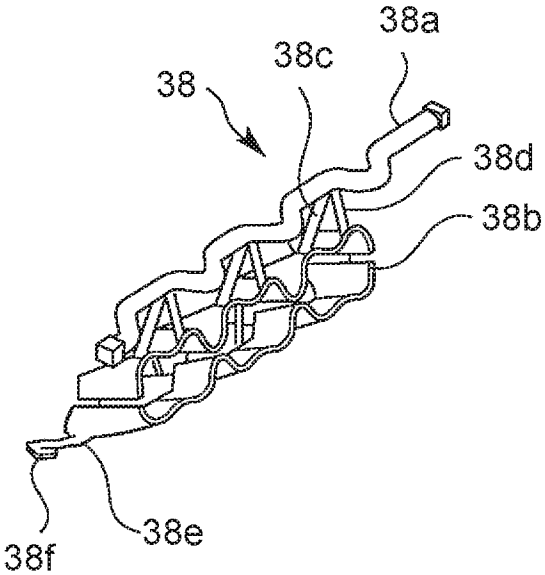
FIG. 8C is an enlarged view of a cooling-water flow-passage core that is an assembly target of the assembling method according to the present embodiment.

In Step S3 as shown in FIG. 6A, the cooling-water flow-passage core 38 is supported by the water-passage support member 34. While the cooling-water flow-passage core 38 is supported, the cooling-water flow-passage core 38 and the intake-port cores 36 are combined, and the cooling-water flow-passage core 38 and the combustion-chamber core 32 are joined together. As shown in FIG. 6A and FIG. 8C, the cooling-water flow-passage core 38 includes: a main-flow passage part 38*a* having the same outer shape as that of the main flow passage 21 as described with reference to FIG. 2 to FIG. 4; a water-jacket part 38*b* having the same outer shape as that of the water jacket 22 as described with reference to FIG. 2 to FIG. 3; a sub-flow-passage part 38*c* having the same outer shape as that of the sub-flow passage 23; an auxiliary-flow-passage part 38*d* having the same outer shape as that of the auxiliary flow passage 24; and a connecting-flow-passage part 38*e* having the same outer shape as that of the connecting flow passage 25. As shown in FIG. 8C, fitting parts 38*f* each having a shape corresponding to the shape of each groove 32*d* are formed at the tips of the connecting-flow-passage parts 38*e*. The intake-port cores 36 are inserted from the extending parts 36*e* of the intake-port cores 36 into the water-jacket part 38*b*, thereby combining the cooling-water flow-passage core 38 and the intake-port cores 36. The fitting parts 38*f* are fitted into the grooves 32*d*, thereby joining the cooling-water flow-passage core 38 to the combustion-chamber core 32. Thereafter, the both ends of the main-flow passage parts 38*a* are disposed to the water-passage support member 34 so as to support the cooling-water flow-passage core 38 by the water-passage support member 34.

Figure 9:
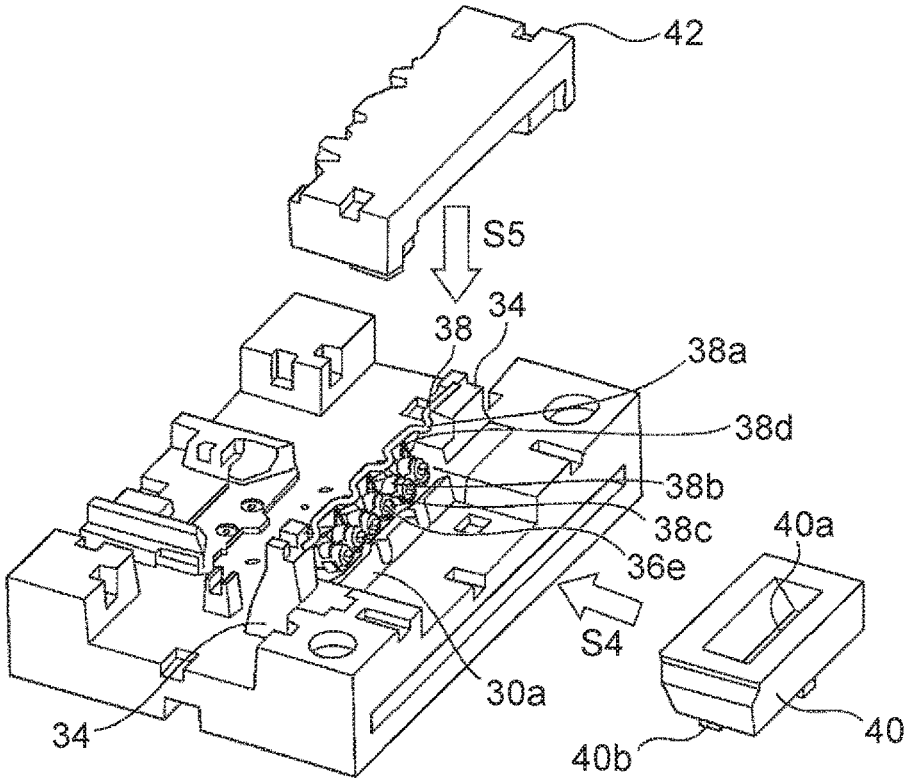
FIG. 9 is a drawing used for explaining Step S4 in FIG. 6B and Step S5 in FIG. 7A.

In Step S4 subsequent to Step S3, the core print part 40 that is common to the three intake-port cores 36 and has a greater width than a width for these cores 36 in an arrangement direction of the intake-port cores 36 is assembled to a predetermined position in the lower die 30. In the assembly of the core print part 40, the core print part 40 is joined to the intake-port cores 36. Although not illustrated in FIG. 6B, accepting grooves each having a shape corresponding to the shape of each extending part 36*e* are formed in a side surface of the core print part 40. The extending parts 36*e* are fitted into these accepting grooves so as to join the core print part 40 to the intake-port cores 36. FIG. 9 shows the core print part 40 before being assembled to the lower die 30. As shown in FIG. 9, a positioning part 30*a* is formed at a predetermined position in the lower die 30. In Step S4 as shown in FIG. 6B, this positioning part 30*a* is combined with a fitting part 40*b* formed in a lower surface of the core print part 40.

Figure 6B:
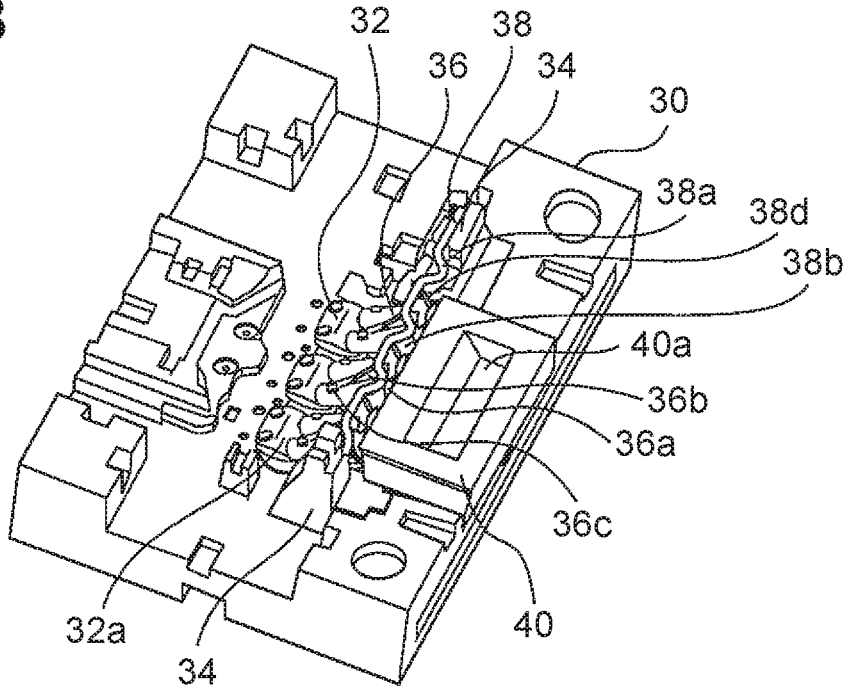
FIG. 6B is a drawing used for explaining the flow of the assembling method according to the embodiment.
Figure 11:
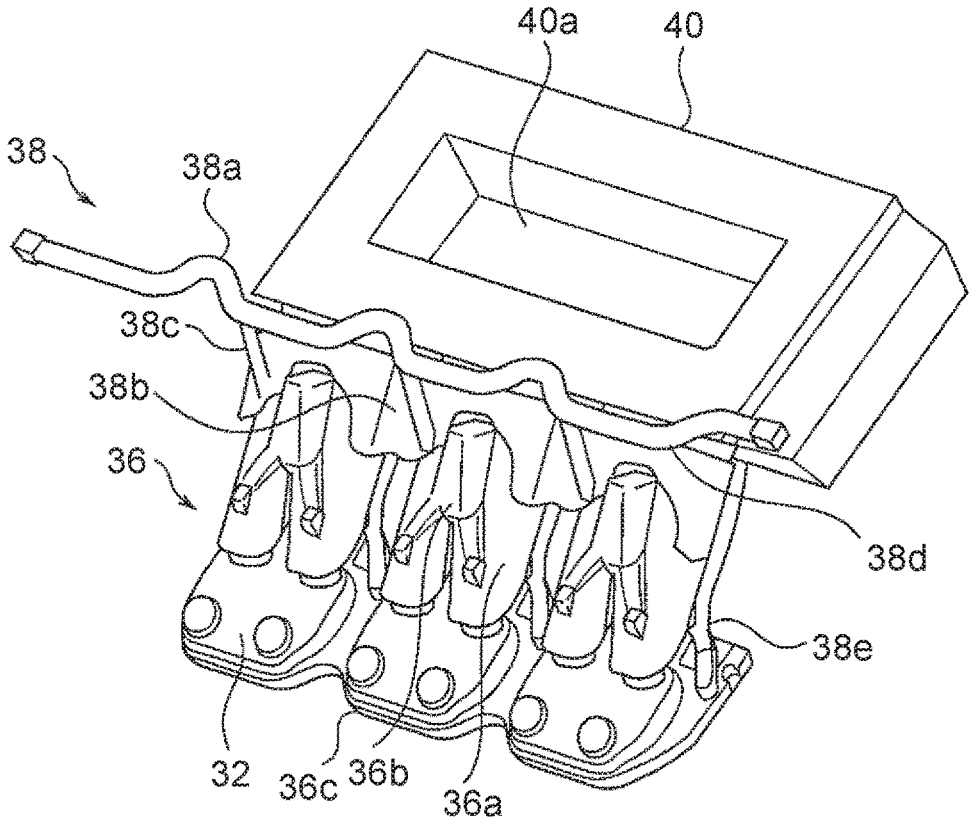
FIG. 11 is a drawing used for explaining the cores immediately after Step S4 in FIG. 6B.

In FIG. 10 to FIG. 11, the respective cores immediately after Step S4 as shown in FIG. 6B are illustrated. As shown in FIG. 10, the shape of each extending part 36*e* is configured to be a straight type extending in a horizontal direction from one longitudinal end of each corresponding body part 36*a*. According to this shape of each extending part 36*e*, when the positioning parts 30*a* are combined with the fitting parts 40*b* as shown in FIG. 9, it is possible to easily fit the extending parts 36*e* into the accepting grooves of the core print part 40 by slidingly moving the core print part 40 along the surface of the lower die 30. According to the extending parts 36*e* each having such a shape, it is possible to resist buoyancy acting onto the intake-port cores 36 while molten aluminum is poured into the die, thus enhancing positioning accuracy of the intake-port cores 36.

As shown in FIG. 10 to FIG. 11, a distance between the wall surfaces of the body parts 36*a* and an inner wall of the water-jacket part 38*b* is very small. The reason why the body parts 36*a* and the water-jacket part 38*b* can be arranged with such a small distance therebetween is because the intake-port cores 36 are configured as separate bodies from the core print part 40. In the present embodiment, the intake-port cores 36 are joined to the combustion-chamber core 32 in Step S2 as shown in FIG. 5B, so that it is impossible to insert the combustion-chamber core 32 into the water-jacket part 38*b*. This means that in Step S3 as shown in FIG. 6A, it is impossible to insert the intake-port cores 36 from the combustion-chamber core 32 side into the water-jacket part 38*b*.

However, even if the joining of the intake-port cores 36 to the combustion-chamber core 32 is carried out later in Step S2 as shown in FIG. 5B, it is also impossible to insert the intake-port cores 36 from the bent part 36*d* side into the water-jacket part 38*b* as long as the port-injector parts 36*b* are formed in the intake-port cores 36. This is because, in order to reduce the distance between the upper surfaces 2*a* and the lower surfaces 2*b* of the intake ports 2, and the water jacket 22 as described with reference to FIG. 2 and others, if the distance between the wall surfaces of the body parts 36*a* and the inner wall of the water-jacket part 38*b* is reduced, the port-injector parts 36*b* projectingly formed on the wall surfaces of the body parts 36*a* become hindering. Consequently, it is possible to insert the intake-port cores 36 only from the extending part 36*e* side thereof into the water-jacket part 38*b*; but if the intake-port cores 36 are integrated with the core print part 40, the core print part 40 having a greater width than that of the intake-port cores 36 then becomes hindering. To cope with this, by configuring the intake-port cores 36 and the core print part 40 to be respective separate bodies from each other, it is possible to insert the intake-port cores 36 from the extending part 36*e* side thereof into the water-jacket part 38*b* in Step S3 as shown in FIG. 6A. Accordingly, it is possible to enhance cooling effect of the air flowing through the intake ports.

Figure 7A:
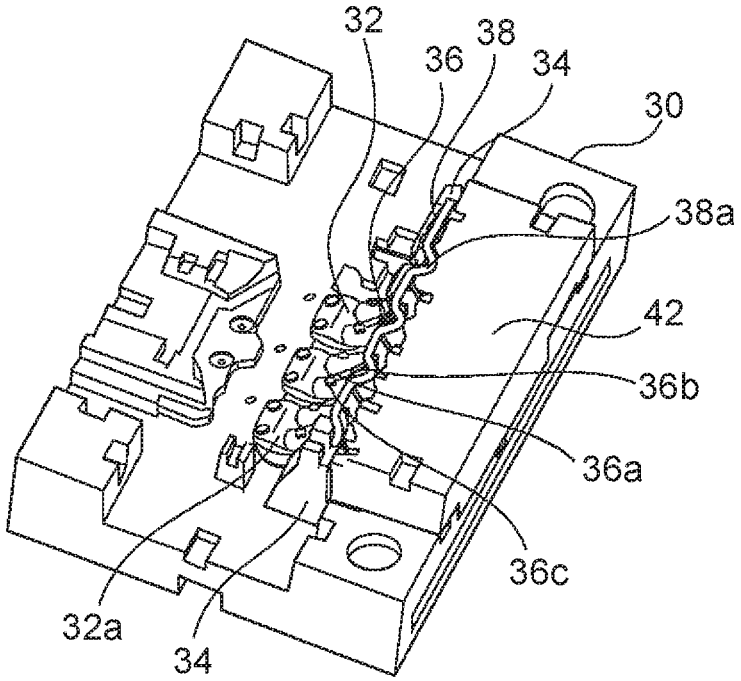
FIG. 7A is a drawing used for explaining the flow of the assembling method according to the embodiment.

In Step S5 as shown in FIG. 7A, a core-print-portion fixing member 42 is combined with the core print part 40. In FIG. 9, the core-print-portion fixing member 42 before being assembled to the lower die 30 is illustrated. In FIG. 12, the cores immediately after Step S5 as shown in FIG. 7A, the core print part 40, and the core-print-portion fixing member 42 are illustrated, and in this drawing, the elements located on the core print part 40 side are partially illustrated in a cut section for convenience of explanation. As shown in FIG. 9 and FIG. 12, a groove 40*a* in an inverse truncated pyramid shape is formed in an upper surface of the core print part 40. As shown in FIG. 12, a truncated pyramid part 42*a* having a shape corresponding to the shape of the groove 40*a* is formed in a lower surface of the core-print-portion fixing member 42. The truncated pyramid part 42*a* is fitted into the groove 40*a* so as to combine the core-print-portion fixing member 42 and the core print part 40. According to the above-configured core-print-portion fixing member 42, it is possible to resist buoyancy acting on the intake-port cores 36 while the molten aluminum is poured into the die through the core print part 40 (more precisely, the accepting grooves of the core print part 40 fitted to the extending parts 36*e*), thus enhancing positioning accuracy of the intake-port cores 36.

Figure 7B:
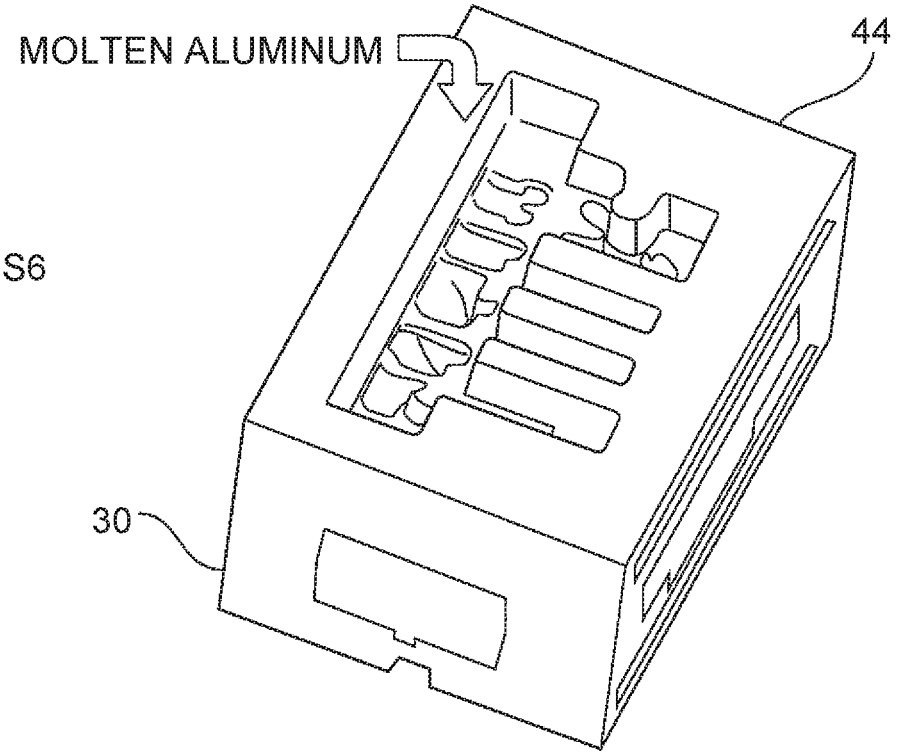
FIG. 7B is a drawing used for explaining the flow of the assembling method according to the embodiment.

In Step S6 subsequent to Step S5, there are assembled, to the lower die 30, the cores used for forming the exhaust port 3, the intake valve-gear chambers 5, the exhaust valve-gear chambers 6, and others as explained with reference to FIG. 2 to FIG. 3 in the cylinder head; thereafter, an upper die 44 is combined with the lower die 30. As shown in FIG. 7B, the molten aluminum is poured from the upper surface side of the upper die 44 into the die. After the cylinder head is molded, the casting is separated from the die, and a subsequent processing to break the cores including the intake-port cores 36 and others into pieces to be removed, or the like are carried out, thereby producing the cylinder head 1 having the configuration as described with reference to FIG. 1 to FIG. 4.

In the aforementioned embodiment, the body parts 36*a* correspond to "port main bodies", the port-injector parts 36*b* correspond to "injector parts", the water-jacket part 38*b* corresponds to a "water-jacket core", and one longitudinal ends of the body parts 36*a* located on the extending part 36*e* side correspond to "core-print-part joined ends", respectively.

<Another Example of Assembling Method of Cores>

In the aforementioned embodiment, as described with reference to FIG. 10 to FIG. 11, each body part 36*a* is configured to have the same outer shape as that of each intake port 2 as described with reference to FIG. 2, etc. However, the outer shape of each body part 36*a* may be variously changed as long as the intake-port cores 36 can be inserted from the extending part 36*e* side thereof into the water-jacket part 38*b*. For example, each body part 36*a* as shown in FIG. 10 to FIG. 11 may be reduced in longitudinal dimension as short as to a vicinity of each corresponding port-injector part 36*b*, and the core print part 40 may be so extended as to extend the joint surface of the core print part 40 facing the body parts 36*a*, thereby compensating this reduction in longitudinal dimension. In the case of extending the joint surface in this manner, it is also possible to reduce the distance between the wall surfaces of the body parts 36*a* and the inner wall of the water-jacket part 38*b*. Accordingly, it is possible to enhance the cooling effect relative to the air flowing through the intake ports, as with the aforementioned embodiment.

In the aforementioned embodiment, as described with reference to FIG. 10 to FIG. 11, each extending part 36*e* is configured to extend from the one longitudinal end of each corresponding body part 36*a* in a horizontal direction. However, each extending part 36*e* may be inclined relative to the horizontal direction. Even in the case of using the extending parts 36*e* inclined relative to the horizontal direction, by fitting the extending parts 36*e* into the corresponding accepting grooves of the core print part 40, it is possible to resist the buoyancy acting on the intake-port cores 36 while the molten aluminum is poured into the die. Accordingly, as with the aforementioned embodiment, it is possible to enhance the positioning accuracy of the intake-port cores 36.

What is claimed is:

1. A method of assembling cores to a die, the cores used for casting a cylinder head of an engine including: an intake port which includes an injector insertion part; and a water jacket covering a part of a wall surface of the intake port, the cores including: an intake-port core provided with a body part used for forming the intake port and an injector part that is projectingly provided on a wall surface of the body part and is used for forming the injector insertion part; a water-jacket core provided with an inner wall corresponding to the part of the wall surface of the intake port; and a core print part used for assembling the intake-port core to the die, the core print part being joinable to a longitudinal end of the body part, and having a greater width than a width of the body part, the method comprising:

inserting the body part from a core-print-part joined end of the body part at which the body part is joined to the core print part, into the water-jacket core;

inserting a portion of the body part located closer to the core-print-part joined end than to the injector part, inward of the inner wall of the water-jacket core; and joining the core print part to the core-print-part joined end after the body part is inserted into the water-jacket core.

2. The method according to claim 1, wherein the cylinder head forms a part of a combustion chamber connected with the intake port, the cores further include a combustion-chamber core joinable to an end opposite to the core-print-part joined end of the body part and assemblable to the die, and the method further comprises:

before inserting the body part into the water-jacket core, assembling the combustion-chamber core to the die, and joining the end opposite to the core-print-part joined end of the body part to the combustion-chamber core assembled to the die.

3. The method according to claim 2, wherein the intake-port core further include a bent part provided to the end opposite to the core-print-part joined end of the body part, the combustion-chamber core further includes a bent-part-accepted groove having a shape corresponding to a shape of the bent part, and the bent part is fitted into the bent-part-accepted groove so as to join the intake-port core to the combustion-chamber core.

4. The method according to claim 1, wherein the intake-port core further includes an extending part at the core-print-part joined end, the core print part further includes an accepting groove having a shape corresponding to a shape of the extending part, and the extending part is fitted into the accepting groove so as to join the intake-port core to the core print part.

5. The method according to claim 4, wherein the core print part further includes a fitting part combinable with a positioning part of a lower die of the die, and when the accepting groove and the extending part are fitted to each other, the core print part is moved along a surface of the lower die so as to combine the positioning part and the fitting part.

6. The method according to claim 4, wherein the die further include a core-print-portion fixing member configured to fix a position of the core print part in the die by combining the core-print-portion fixing member and the core print part, and the method further comprises:

after the core print part is joined to the core-print-part joined end, pushing the core-print-portion fixing member from above the core print part so as to combine the core print part and the core-print-portion fixing member.

7. The method according to claim 1, wherein the water jacket covers a part of an upper surface and a part of a lower surface of the wall surface of the intake port.

* * * * *